United States Patent [19]

von Hagen et al.

[11] Patent Number: 4,475,474

[45] Date of Patent: Oct. 9, 1984

[54] METERING DEVICE FOR SEWING MACHINES

[75] Inventors: Wolf R. von Hagen; Johannes K. Strauss, both of Hemmingen, Fed. Rep. of Germany

[73] Assignee: Union Special G.m.b.H, Stuttgart, Fed. Rep. of Germany

[21] Appl. No.: 434,458

[22] Filed: Oct. 15, 1982

[30] Foreign Application Priority Data

Oct. 24, 1981 [DE] Fed. Rep. of Germany ..... 3142195

[51] Int. Cl.[3] ..... D05B 21/00

[52] U.S. Cl. ..... 112/121.26; 112/152; 112/305

[58] Field of Search ..... 112/121.26, 121.27, 112/121.29, 121.11, 121.15, 2, 152, 303, 305; 242/55

[56] References Cited

U.S. PATENT DOCUMENTS

| | | | |
|---|---|---|---|
| 2,681,019 | 6/1954 | Liebowitz | 112/121.26 X |
| 2,723,636 | 11/1955 | Galkin | 112/121.26 X |
| 2,754,114 | 7/1956 | Weinkle et al. | 112/121.26 X |
| 3,847,099 | 11/1974 | Braun | 112/152 |
| 3,856,224 | 12/1974 | van der Aa et al. | 112/121.26 X |

*Primary Examiner*—H. Hampton Hunter

*Attorney, Agent, or Firm*—John W. Harbst; John A. Schaerli

[57] ABSTRACT

A device for automatically supplying a strip of elastic tape material to a sewing machine under tension. The device uniquely combines a tape supply mechanism, for tractively propelling the tape, and a tape tensioning assembly which guides the tape along a predetermined path of travel while measuring the amount or degree of tape tension. The tape supplied is under the control of the tape tensioning apparatus which may include a mechanism for selectively modulating the degree of tape tension.

16 Claims, 4 Drawing Figures

METERING DEVICE FOR SEWING MACHINES

FIELD OF THE INVENTION

This invention relates to generally to sewing machines and, more particularly, to an elastic metering device for sewing machines.

BACKGROUND OF THE INVENTION

Mechanisms for drawing tape from large tape reels and delivering same to a sewing machine under tensionless conditions are known. Such mechanisms are usually responsive to machine speeds. Devices for metering the amount of tape delivered to the sewing machine are well known. With such devices, however, the elastic is usually delivered according to machine speeds. At high speeds, mechanisms which operate as a function of machine speed have a tendency to inadequately control the elastic tape tension as a result of overthrow of the mechanism. To produce acceptable workpieces, the elastic tape supply and tension must be controlled.

SUMMARY OF THE INVENTION

As disclosed hereinafter, the present invention has essentially solved the drawbacks of the heretofore known devices and answers the needs of today's industry. Unlike other mechanisms, the present invention is not directly responsive to machine speeds. Instead, the present invention is responsive to tape usage in that it senses the actual amount of tape consumed in the sewing process. In other words, the present invention is outcome orientated in that it is not governed by machine speed but instead operates substantially independent thereof.

To accomplish these ends, the present invention uniquely combines a tape supply mechanism and a tensioning means for guiding the tape along a predetermined path of travel in response to machine usuage requirements. In its present form, the mechanism of the present invention initially draws tape from a tape reel and guides same thru a series of rotatable members which are arranged to the traveling tape into a longitudinally extendable tape loop. One of the rotatable members is orientated on a pivot arm in such a way as to rest in a depending tape loop whereby exerting a selectively adjustable stretching effect on the tape. Means for measuring the amount or degree of tension in said tape loop serve to control the tape supply mechanism as a function of tape tension. Means are also provided for automatically or selectively varying the degree of tape tension while the machine is operating.

With the above in mind, it is a primary object of this invention to provide an apparatus which effectively and efficiently provides elastic tape to a machine as required thereby.

Another object of this invention is to provide a mechanism which will furnish elastic tape under tension to a receiving machine at a rate consistent with the demands thereof.

Still another object of this invention is the provision of an apparatus for furnishing elastic tape to a machine under preselectable or selectively variable degrees of tension.

Another object of this invention is to provide a simple mechanism which readily responds to the machines needs but yet is indirectly independent thereof.

BRIEF DESCRIPTION OF THE DRAWINGS

Having in mind the above objects and other attendent advantages that would be evident from an understanding of this disclosure, the invention comprises the devices, combination and arrangements of parts as illustrated in the presently preferred form of the invention which is hereinafter set forth in detail to enable those skilled in the art to readily understand the function, operation, construction and advantages of same when read in conjunction with the accompanying drawings in which.

DETAILED DESCRIPTION OF THE PRESENT INVENTION

Figure 1:
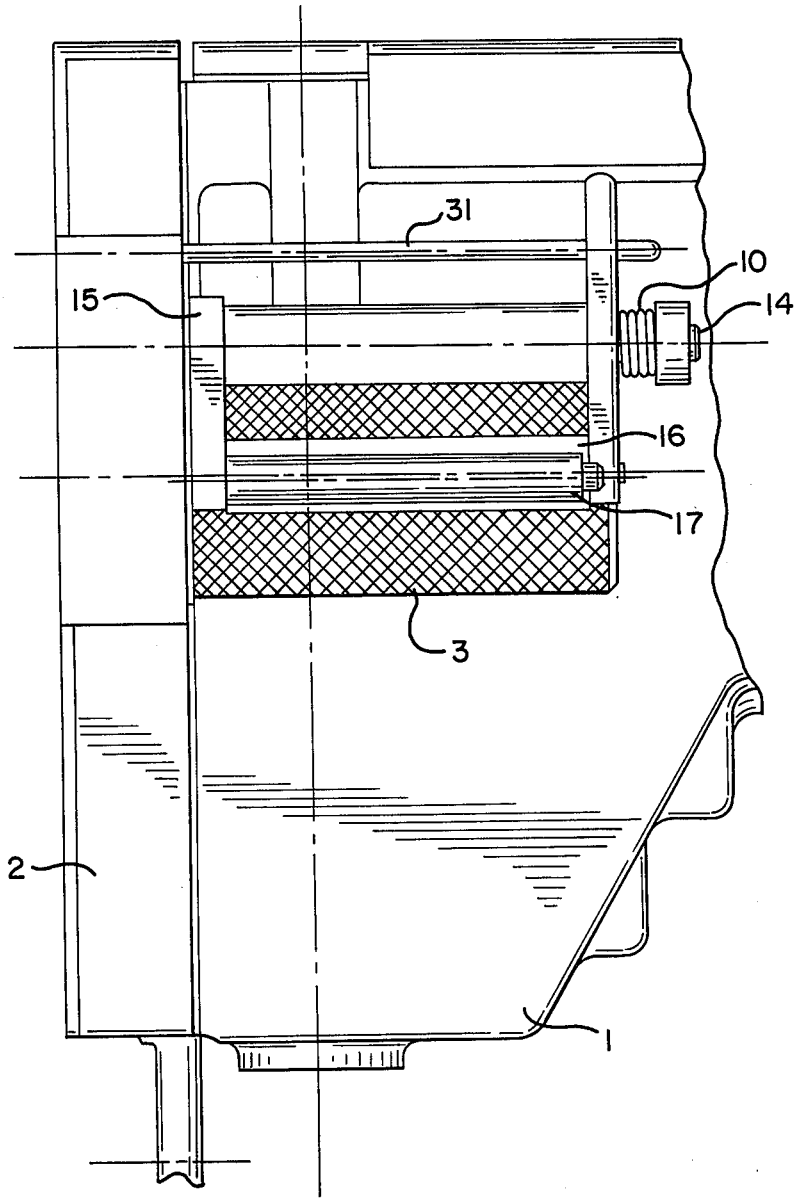
FIG. 1 is a partial front elevational view of a sewing machine incorporating the present invention.

To simplify the invention's disclosure, the drawings illustrate very little of the structure of sewing machine to which the invention is applied. Suffice it to say, the sewing machine, to which the invention may be readily applied, is sold by Union Special Corporation under the general class designation of 34800. Such a sewing machine is of the chainstitch type and includes the usual stitch forming instrumentalities as well as feed mechanism means for incrementally advancing a material workpiece past the stitch forming instrumentalities.

Referring now in detail to the drawings, wherein like reference numerals indicate like parts throughout the several views, the machine to which the instant invention is applied has the usual overhanging arm which terminates in a hollow needle or sewing head 1. Within the head there is mounted for endwise reciprocal motion, a needle bar which carries one or more thread carrying needles (not shown) defining a stitching area or zone. The sewing head is normally covered by a removable cover or plate which provides access to the operating mechanisms in the head. A modified support or plate 2 replaces the normal cover when the strip metering device of the instant invention is added. The substitute plate furnishes one support for the additional mechanisms comprising the elastic tape metering device.

Figure 2:
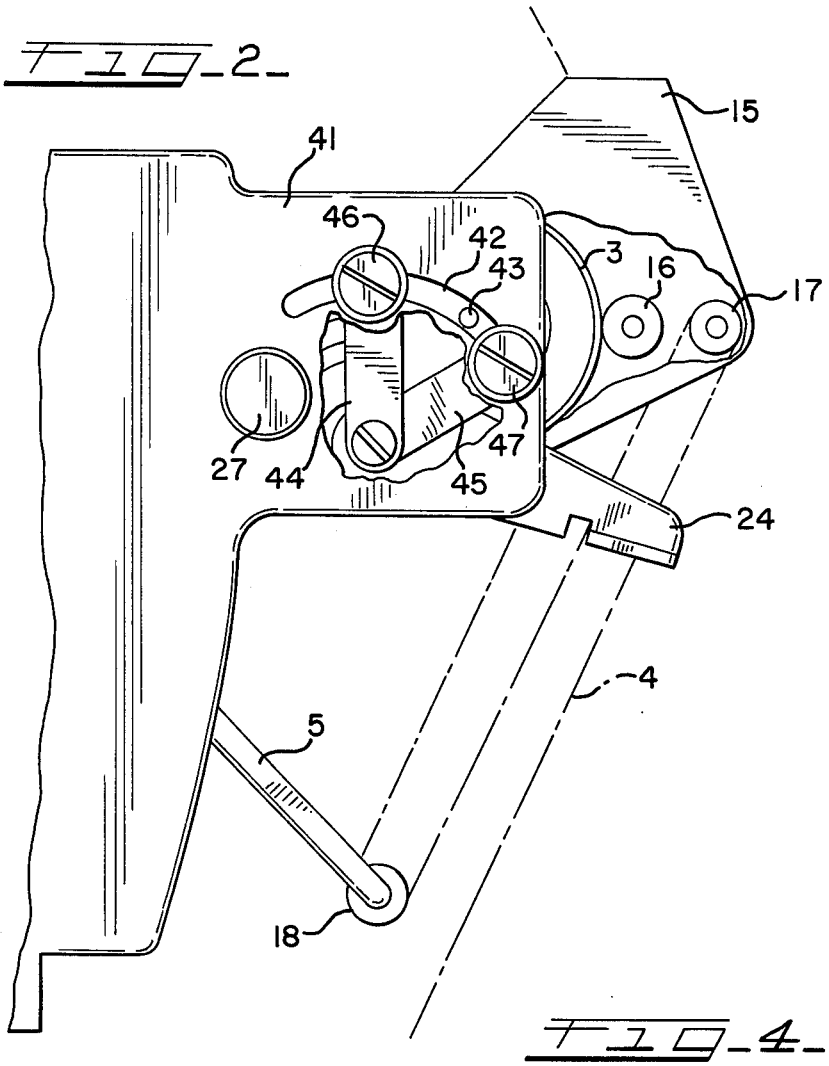
FIG. 2 is a partial side elevational view showing the present invention.
Figure 4:
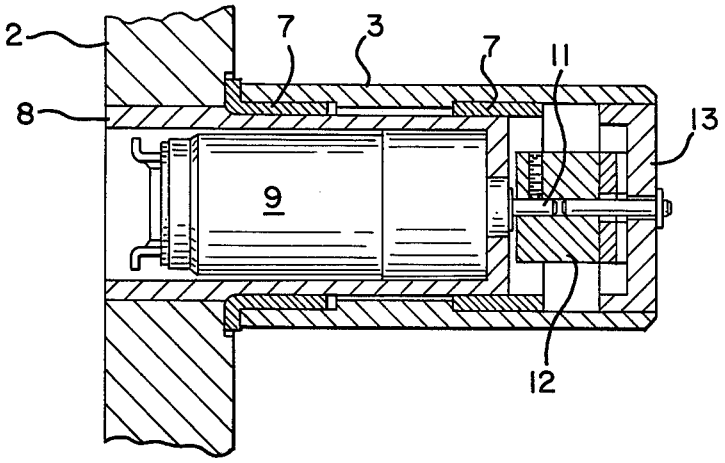
FIG. 4 is a sectional view through the tape supply mechanism of the present invention.

Turning now to the present invention which uniquely combines a tape pull-off or drawing mechanism and a tape tensioning apparatus. In its path of travel to the stitch forming instrumentalities of the machine the strip or tape 4 which is to be sewn may unwind from a supply source (not shown) and is initially introduced to the tape supply or metering mechanism of the present invention. As best illustrated in FIG. 2, the tape supply means includes a knurled drive roller means 3 which, as its name implies, furnishes the necessary power to remove tape from the supply source. The drive roller also cooperates with the other mechanisms of the present invention to tension the tape. The drive roller 3 is mounted on a fixed rotational axis. In the presently preferred embodiment, best illustrated in FIG. 4, the drive roller 3 is rotatably carried on a set of bearing means 7 which, in turn, are supported by a cantilevered sleeve 8 extending from the support 2. The feed roller 3 may be driven independent of the machine by a drive source 9, the current for which is supplied from an outside source by any suitable means. Preferably, and to conserve space, the drive motor 9 is arranged within the sleeve 8. With the motor so disposed, the output shaft 11 of the drive motor is operatively coupled to the feed roller by means of a coupling element 12 and end cover 13.

Cooperating with the metering drive roller 3 is a smaller presser roller 16 which serves to hold the strip or tape against roller 3 and grip it to prevent slipage. As shown in FIG. 2, roller 16 may be supported by a carrier means 15 rotatably arranged on a shaft 14 (FIG. 1) journaled in the support 2. The carrier 15 may also provide the support means for an idler or deflecting roller 17. A torsion spring 10, arranged about the shaft 14, has one end engaging the support 15 and its other end engaged with an adjustable collar secured to the outer end of the shaft 14. By this construction, the spring tends to urge the support in a direction such that roller 16 is continually retained in frictional engagement with drive roller 3.

Figure 3:
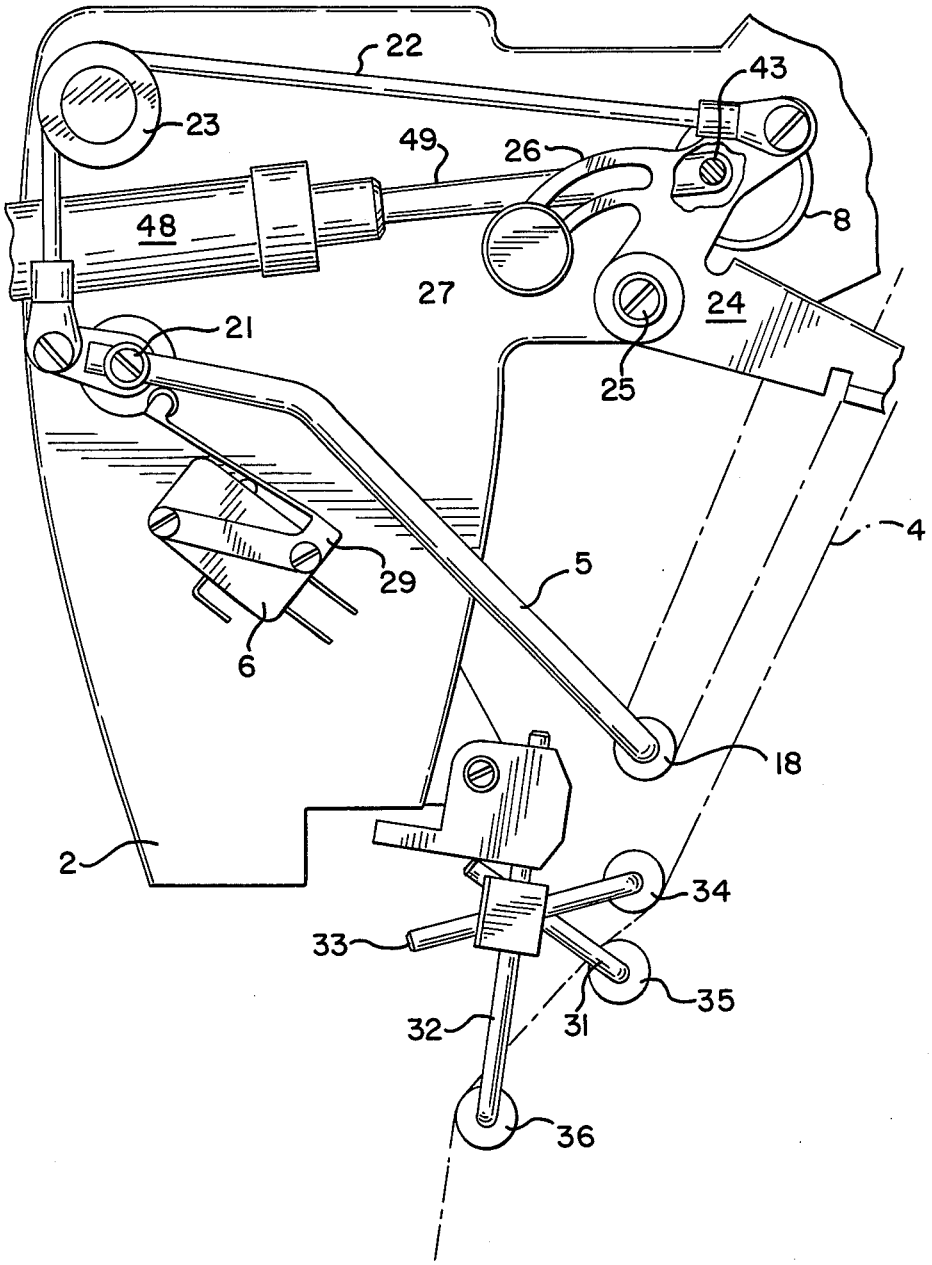
FIG. 3 is the device according to FIG. 2 with its end cover removed.

Upon passing through the tape driver 3, the longitudinally extendable tape is then passed along a predetermined path of travel preferably through a loop forming area. That is, from the drive roller means 3, the tape is passed into a depending loop arrangement provided by a series of appropriately arranged freely rotatable members including tensioning roller means 18 and idler roller means 17. Turning again to FIG. 2, in the preferred embodiment, the tensioning roller 18 is vertically movable and is positionally arranged such that it rests in a downwardly extending loop of tape between the drive roller 3 and idler roller 17. The tensioning roller thus cradled acts as a longitudinal tape stretching means and is adapted to exert a downward stretching or tensioning effect on the longitudinally extendable tape in a manner discussed below. As shown in FIG. 3, a series of rollers 34, 35 and 36 carried on posts 33, 31 and 32, respectively, serve to further guide the tensioned tape to the stitch forming instrumentalities.

As best seen in FIG. 3, the tensioning roller 18 is carried on the free end of a fulcrumed pivot arm 5. Intermediate its ends, the arm is fulcrumed about a pivot point 21 to permit unhindered vertical movement of the tensioning roller 18. The fulcrum point for the lever 5 is provided by its articulate connection with the support 2. The other end of lever 5 is connected to a resilient member 22 in the form of a spring pull. Member 22 may pass from its connection with lever 5, around or over a roller 23 and is connected at its other end to an apparatus or means capable of selectively modulating the degree or amount of tension applied to the longitudinally extendable tape. Such adjustable means includes a bell crank lever 24 which is pivotally secured to the support 2 by means of a fastener 25. By this construction, the force exerted by the resilient member 22 ultimately causes the tensioning roller 18 to bear down on the depending tape loop portion thus exerting a tension or stretching force to the tape 4. Alternatively, an adjustably positionable weight mounted on the lever arm 5 on the side of the fulcrum pin opposite the roller 18 could be used to establish a like adjustable bias. By adjusting the position of such a weight or mass, the tension force exerted on the tape could be modulated in a manner similar to using the resilient member 22.

The ajustable means for modulating the degree or amount of tension applied to the tape may be preset prior to operation of the machine. Thus the operator may premeasure the stretch of the resilient member and, ultimately, the tension applied by the tensioning roller 18. As will be apparent, the amount or degree of tension applied to the tape by tension roller is easily calibrated through the angular disposition of lever 24. The provision of suitable locking means allows for selective securement of the bell crank lever 24 in any desired position. In the preferred embodiment, the locking means for the bell crank lever includes a slotted bell crank extension 26 and a cooperatively arranged releasable fastening means 27 which is readily accessible to the operator.

Means are also provided for measuring or sensing the amount or degree of tension applied to the tape as it passes along its predetermined path of travel. The sensing means is arranged on the support 2 and includes tape tension responsive switch means 6 having an arm 29 that serves to sense or monitor the angular disposition of the arm 5. The switch is connected to and controls the advance rate or operation of the drive motor 9 for the drive roller 3 whereby controlling the amount of stretch or tension applied to said tape as will be subsequently discussed. The exact wiring details of the motor and switch means are omitted since such minutiae details are well known to those skilled in the art and their inclusion would merely obscure the important internal details residing at the heart of the invention.

As will now be apparent, in operation, the switch means 6 effectively monitors the tension in the tape as it passes along its predetermined path of travel and provides an automatic control or measuring means serving to shut off current to the drive motor 9 when the tape tension is lessened to a predetermined value. Likewise, the switch means reactivates the motor 9 when the tape tension exceeds a predetermined amount resulting from the tape being consumed in the sewing process. As should be evident to one skilled in the art, the deactivation of the tape supply means by switch means 6 cause roller 3 to act as a brake means resulting in an increase in tape tension in the loop forming area arranged between the feed drive roller 3 and the stitch forming instrumentalities of the machine. As a result, tensioning roller, riding in the contracting tape loop, rises until the switch arm 29 sufficiently moves to change the state of the switch 6. The change of state of the switch means 6, reactivates the motor thus allowing feed roller to introduce more tape into the loop forming area. As a result, the tension on the tape is returned to its normal state as a result of the tape tensioning adjustment as monitored by the switch means 6.

As should be readily apparent, the tension on the tape may be selectively varied during operation of the apparatus. To control the variance of the tape applied tension within certain parameters during operation, the present invention provides limit stops. To accomplish this end, the support member 2 may be provided with a cover plate 41 having an arcuate slot 42. A projecting member, in the form of a pin 43, extends from and is carried by the bell crank lever 24 and projects through such arcuate slot 42. The Limit stops 44 and 45 are adjustably supported about the turning axis of the bell crank lever 24 and are disposed in the arcuate slot. The positions of the limit stops may be selectively arranged by means of operator accessible fasteners 46 and 47, respectively. By this construction, the extent of movement of lever 24 may be controlled between two positions, i.e. minimum and maximum.

With the embodiment shown, when the fastener 27 releases the lever from its locked position, the resilient member 22 normally exerts an influence on the lever 24 to pull same against limit stop 44. The tape fed to the stitching point is normally sewn on with a tension determined by the limit stop 44. This tape tension, however, may be changed as desired. To accomplish this end, the operator may, at will, change the angular disposition of lever 24 to the extent that pin 43 engages limit stop 45 or at any position therebetween. The change in the angular disposition of lever 24 effects the resilient member 22 thus causing tensioning roller 18 to bear down with varying degrees of force on the tape loop ultimately resulting in an increase in tape tension. A foot lever or knee press (not shown) may be provided for manually pivoting the lever 24. Alternatively, actuator means may be employed for automatically adjusting the tape tension according to a predetermined sequence. As shown in FIG. 3, such apparatus may include a drive member 48 whose operative end is operatively connected to the pin 43. Preferably, such drive member would be in the form of a pneumatic cylinder or electro mechanical apparatus. Such an actuator may be controlled by either a preset timer or counter apparatus (not shown) such that a change in tape tension may exist for some predetermined period and then return to the normal tension state. The limit stops 45 and 46 would serve the same purpose with an automatic actuator as they had with the manual operation.

As is now evident, the present invention, by virtue of its unique combination of cooperating parts serves to unwind a strip of elastic tape from a supply source and feed it to a sewing machine under tension or under varying degrees of tension. In this manner, workpieces having varying elastic requirements can be readily handled with the present invention. As is clear, the above noted objects of our invention can be achieved with unparalleled excellence through the use of the present invention.

Thus there has been provided an elastic Metering Device that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Thus, having adequately described the invention, what we claim is:

1. A tape feeding system for a sewing machine, comprising:

a plurality of rotative members for guiding a tape including drive roller means, tensioning roller means and idler roller means so arranged to form said tape into a tape loop in which the tensioning roller means ride;

said tensioning roller means being mounted on a pivot arm and adapted for vertical movement such that it bears down on a portion of the tape loop to place the tape under tension;

means for driving said drive roller means; and motor control means responsvie to the disposition of said pivot arm for controlling the driving means whereby controlling the degree of tension applied to said tape.

2. The invention according to claim 1 wherein said pivot arm is biased under the influence of an adjustable resilient member.

3. The invention according to claim 2 wherein said resilient member is a spring.

4. A tape feeding system for a sewing machine comprising:

a loop forming area for receiving a tape;

stretching means for applying tension to the tape arranged in said tape loop;

means for measuring the degree of tension applied to said tape by said stretching means; and a tape feeding means receiving input from said measuring means to control the amount of tape introduced into said loop forming area.

5. An apparatus for supplying tape to a sewing machine under tension compising:

tape feeding means;

tape tensioning means;

means for measuring the amount of tension on said tape;

means controlled by said measuring means for controlling the rate of operation of said tape feeding means.

6. In combination with a sewing machine having a supporting arm for a stitching mechanism, a mechanism for feeding elastic tape to the stitching mechanism, said mechanism comprising:

elastic metering means mounted on said sewing machine for advancing a longitudinally elastic strip;

means arranged following the elastic metering means in the direction of tape advancement for creating a distended elastic tape loop including means for longitudinally stretching the tape arranged in said loop; and means for controlling the amount of stretch applied to the tape arranged in the tape loop.

7. The mechanism according to claim 6 further including means for selectively varying the tension of said stretching means during operation of the mechanism.

8. An apparatus suited for use in supplying tape to a sewing machine under tension, said apparatus comprising:

a plurality of rotatable members including a drive roller, said rotatable members being relatively mounted for threading thereabout a portion of unwound tape in a manner defining a depending tape loop;

one of said rotatable members being mounted on a pretensioned pivot arm and is adapted for vertical movement such that it bears down on the bottom of the thread loop to hold the tape under tension;

a motor operatively coupled to the drive roller; and motor control means responsive to the disposition of the pivot arm for controlling the operation of the motor and ultimately controlling the amount of slack in the thread loop.

9. The apparatus according to claim 8 wherein said drive roller is supported on a sleeve extending from a support carried by said sewing machine, said sleeve containing the motor operatively coupled to the drive roller.

10. The apparatus according to claim 8 wherein said rotatable members, said motor and said motor control means are carried by a common support.

11. Apparatus for feeding an elastic tape to a machine, comprising:

tape feeding means;

means arranged to receive and guide the tape fed by said tape feeding means along a predetermined path of travel;

stretching means arranged in the predetermined path of the tape for applying tension thereto; and tape tension responsive switch means for controlling the tape feeding means as a function of the desirable tension to be applied to said tape.

12. The apparatus according to claim 11 further including operative means connected with said stretching means for modulating the amount of tension applied to said elastic tape.

13. The invention according to claim 12 wherein said operative means includes pneumatically operated actuating element means.

14. Apparatus for tensionally advancing a strip to a sewing machine comprising:

a strip feed advance mechanism;

a series of receiving rollers adapted to arrange a strip received from said strip feed advance mechanism in the form of a loop;

operative means for applying tension to the strip in said loop; and control means operative to effect the amount of tension applied to said loop.

15. The apparatus according to claim 14 further including means for varying the amount of tension applied to said strip by said operative means.

16. The invention according to claim 14 wherein limit stops are provided for controlling the extent of strip tension variation.

* * * * *